US008757506B2

(12) United States Patent
Zhou et al.

(10) Patent No.: US 8,757,506 B2
(45) Date of Patent: Jun. 24, 2014

(54) PTAC DEHUMIDIFICATION WITHOUT REHEAT AND WITHOUT A HUMIDISTAT

(75) Inventors: Qianghua Zhou, Onalaska, WI (US); Tedd P. Johnson, La Crosse, WI (US); Todd A. Van Hyfte, Ramsay, MN (US)

(73) Assignee: Trane International Inc., Piscataway, NJ (US)

( * ) Notice: Subject to any disclaimer, the term of this patent is extended or adjusted under 35 U.S.C. 154(b) by 2159 days.

(21) Appl. No.: 11/649,388

(22) Filed: Jan. 3, 2007

(65) Prior Publication Data

US 2008/0156891 A1 Jul. 3, 2008

(51) Int. Cl.
*F24F 3/147* (2006.01)
*F24F 3/14* (2006.01)

(52) U.S. Cl.
USPC ..... 236/44 C; 236/91 D

(58) Field of Classification Search
USPC ..... 236/44 C, 91 D; 62/176.1, 176.2, 176.6; 165/222, 223, 201, 255
See application file for complete search history.

(56) References Cited

U.S. PATENT DOCUMENTS 1,231,570 A * 7/1917 Cramer et al. ..... 236/44 C
3,111,010 A 11/1963 Spofford
3,585,811 A * 6/1971 Friedel ..... 62/173
3,900,301 A * 8/1975 Constantinescu et al. ..... 96/244
3,989,097 A 11/1976 Schildknecht
4,003,729 A 1/1977 McGrath
4,272,014 A * 6/1981 Halfpenny et al. ..... 236/44 B
4,364,234 A * 12/1982 Reed ..... 62/3.3
4,540,118 A * 9/1985 Lortie et al. ..... 236/44 C
4,619,114 A * 10/1986 Wilson ..... 62/180
4,706,882 A * 11/1987 Barnard ..... 236/46 R
4,735,054 A 4/1988 Beckey
4,850,198 A 7/1989 Helt et al.
5,303,561 A 4/1994 Bahel et al.
5,445,214 A * 8/1995 Han ..... 165/11.1
5,743,100 A * 4/1998 Welguisz et al. ..... 62/158
5,769,314 A * 6/1998 Drees et al. ..... 236/49.3
5,915,473 A 6/1999 Ganesh et al.
5,946,923 A * 9/1999 Samukawa et al. ..... 62/133
6,070,110 A 5/2000 Shah et al.
6,076,739 A * 6/2000 Littleford et al. ..... 236/44 R
6,223,543 B1 5/2001 Sandelman
6,397,607 B1 * 6/2002 Camp et al. ..... 62/155
6,427,461 B1 * 8/2002 Whinery et al. ..... 62/176.6
6,668,917 B1 * 12/2003 Zeng ..... 165/202
6,843,068 B1 1/2005 Wacker
6,892,547 B2 5/2005 Strand
7,565,813 B2 * 7/2009 Pouchak ..... 62/126
7,574,871 B2 * 8/2009 Bloemer et al. ..... 62/176.6
7,590,469 B2 * 9/2009 Grohman ..... 700/276

(Continued)

*Primary Examiner* — Ljiljana Ciric
*Assistant Examiner* — Alex Cox
(74) *Attorney, Agent, or Firm* — William O'Driscoll

(57) ABSTRACT

A refrigerant system includes a controller that enables the system to dehumidify the air in a room without relying on a humidistat and without having to operate the system's compressor and electric heater at the same time. To dehumidify the air, the system's compressor, supply air fan, and outside air damper are controlled in a manner similar to other systems operating in a cooling mode when the room temperature is above a certain setpoint temperature. When the room temperature falls below the setpoint, however, the operation changes significantly. The controller closes the outside air damper, decreases the speed of the fan, and continues operating in this manner until the room temperature decreases to a subcooling temperature limit. The subcooling temperature limit is less than a predetermined limit that is used during the system's normal cooling mode.

15 Claims, 3 Drawing Sheets

(56) References Cited

U.S. PATENT DOCUMENTS

| | | | | |
|---|---|---|---|---|
| 7,591,145 | B1 * | 9/2009 | Wiggs | 62/324.4 |
| 7,631,509 | B2 * | 12/2009 | Shavit | 62/150 |
| 7,690,421 | B2 * | 4/2010 | Burns et al. | 165/237 |
| 2008/0017723 | A1 * | 1/2008 | Johnson et al. | 236/51 |
| 2008/0314998 | A1 * | 12/2008 | Herzon et al. | 236/1 C |
| 2009/0277193 | A1 * | 11/2009 | Springer et al. | 62/93 |
| 2010/0064722 | A1 * | 3/2010 | Taras | 62/498 |
| 2010/0096383 | A1 * | 4/2010 | Apicella et al. | 219/494 |

* cited by examiner

PTAC DEHUMIDIFICATION WITHOUT REHEAT AND WITHOUT A HUMIDISTAT

BACKGROUND OF THE INVENTION

1. Field of the Invention

The subject invention generally pertains to almost any type of HVAC refrigerant system but particularly to PTAC units such as those commonly used for hotel rooms. The invention more specifically pertains to a method of providing such systems with a dehumidification mode without using a reheat coil or relying on a humidistat.

2. Description of Related Art

Refrigerant systems are widely used for heating, cooling and dehumidification of a comfort zone such as a room or other area of a building. Dehumidifying air may simply involve cooling the air below its dew point. Cooling alone, however, can make a room uncomfortably cold. Thus, a heater is sometimes activated to offset the cooling effect, whereby the air can be dehumidified without changing the temperature of the room. The use of a heater while dehumidifying by cooling is known as a reheat process.

The reheat process is applicable to various refrigerant systems; however reheat is not always suitable for Packaged Terminal Air Conditioners/Heat Pumps, also known as PTAC units. PTACs are self-contained refrigerant systems often used for cooling and heating hotel rooms; however, they are also used in a variety of other commercial and residential applications such as apartments, hospitals, nursing homes, schools, and government buildings. Even though PTACs often include an electric heater for a heating mode, energizing a refrigerant compressor for cooling/dehumidifying while energizing an electric heater for reheat would draw a lot of electric current. Such current is not always available due to the often-limited current carrying capacity of the wiring leading to each PTAC unit. Although heavier wiring could be installed, the cost of the higher gage wires would need to be multiplied by the total number of PTAC units of a particular installation. For a hotel with numerous PTAC units, the total cost of the wiring is significant.

Another difficulty of providing a PTAC unit with a dehumidifying mode is that typical dehumidification methods involve the use of a humidity sensor. Examples of such systems are disclosed in U.S. Pat. Nos. 6,892,547; 6,843,068; 6,223,543; 6,070,110; 5,915,473; 5,303,561; 4,735,054; 4,003,729; 3,989,097 and 3,111,010. Although a single humidity sensor may not be that expensive, the total cost can be substantial for installations that include numerous PTAC units.

Other dehumidification schemes are disclosed in U.S. Pat. Nos. 5,743,100 and 4,850,198. The '100 patent provides a refrigerant system with additional dehumidification by continuing to operate the supply air fan for a while after the compressor has been de-energized. Although beneficial, the dehumidification that occurs during the extended but limited run time of the fan may not always be sufficient to meet the total dehumidification needs of the comfort zone. The '198 patent discloses a refrigerant system that reduces humidity by momentarily energizing the cooling system after extended off periods. Although such a system is particularly useful during the night when the cooling demand is low, the system is less valuable during periods of high cooling demand.

Due to the cost and various other drawbacks of current dehumidification methods, there exists a need a dehumidification process that is not only suited for PTAC units but is also applicable to other HVAC systems as well.

SUMMARY OF THE INVENTION

It is an object of the present invention is to provide a refrigerant system with a dehumidification mode without relying on a heater for reheat.

Another object of some embodiments is to provide a refrigerant system with a dehumidification mode without using a humidity sensor.

Another object of some embodiments is to prevent overloading a refrigerant system's electrical system by not running the system's compressor and electric heater concurrently.

Another object of some embodiments is to provide dehumidification by closing an outside air damper, decreasing the speed of the supply air fan, and effectively lowering the setpoint temperature.

Another object of some embodiments is to provide dehumidification by automatically closing an outside air damper and decreasing the speed of the supply air fan as the room temperature decreases below a setpoint temperature.

One or more of these and/or other objects of the invention are provided by a refrigerant system that dehumidifies air without relying on a humidistat and without reheating the air. To reduce the humidity, the system closes an outside air damper, decreases the speed of the supply air fan, and effectively lowers the setpoint temperature.

DESCRIPTION OF THE PREFERRED EMBODIMENT

Figure 1:
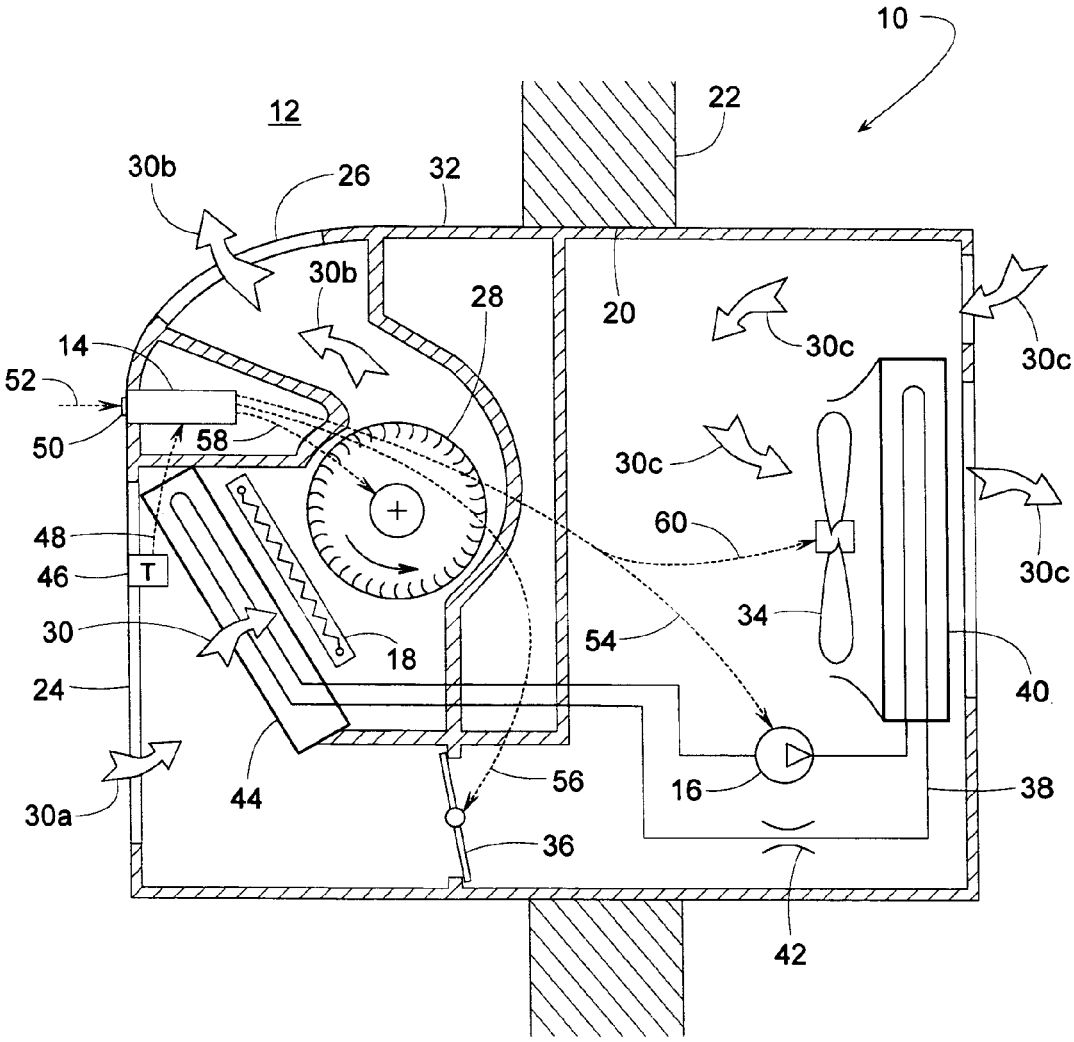
FIG. 1 is a schematically illustrated cross-sectional view of a refrigerant system according to one embodiment of the invention.
Figure 2:
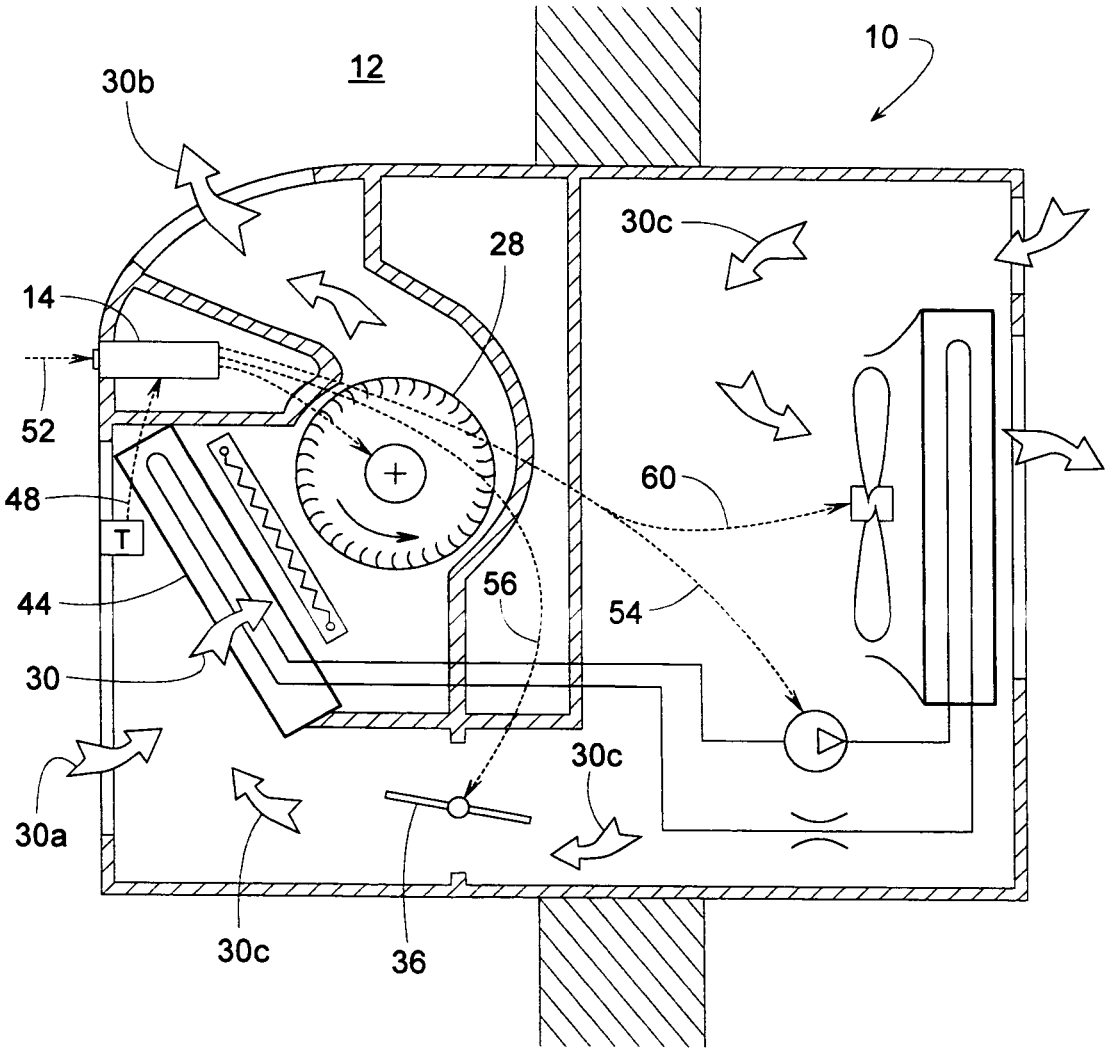
FIG. 2 is a schematic view similar to FIG. 2 but showing the system's damper in an open position.

A refrigerant system 10, schematically shown in FIGS. 1 and 2, can be used for cooling, heating, ventilating or dehumidifying a comfort zone such as a room 12 or other area in a building. System 10 includes a controller 14 that enables the system to provide dehumidification without relying on a humidistat and without having to operate the system's compressor 16 and an optional electric heater 18 at the same time. Although system 10 is illustrated as a PTAC unit, controller 14 can be readily applied to many other types of refrigerant systems as well.

In a currently preferred embodiment, system 10 can be installed at an opening 20 of a building's exterior wall 22. System 10 has an inlet 24 for receiving recirculated return air 30*a* from within room 12 and an outlet 26 for discharging conditioned supply air 30*b* back into room 12. A supply air fan 28 disposed within a housing 32 moves the air from inlet 24 to outlet 26. Housing 32 also contains an outdoor fan 34, a fresh air damper 36, and a refrigerant circuit 38. Refrigerant circuit 38 comprises compressor 16 for compressing refrigerant, an outdoor refrigerant heat exchanger 40, an expansion device 42 (e.g., thermal expansion valve, electronic expansion valve, orifice, capillary, etc.), and an indoor refrigerant heat exchanger 44.

When system 10 operates in a cooling mode, compressor 16 forces refrigerant sequentially through outdoor heat exchanger 40 functioning as a condenser to cool the refrigerant with outdoor air 30*c* moved by fan 34, through expansion device 42 to cool the refrigerant by expansion, and through indoor heat exchanger 44 functioning as an evaporator to absorb heat from air 30 moved by fan 44. As can be seen in FIGS. 1 and 2, fan 28 draws air sequentially through inlet 24, heat exchanger 44 and heater 18 and then discharges the air through outlet 26. If damper 36 is at an open position, as shown in FIG. 2, then air 30 can be a mixture of return air 30*a* and outside air 30*c*. If damper 36 is at a closed position, as shown in FIG. 1, then air 30 is substantially comprised of return air 30*a*.

If refrigerant circuit 38 is a heat pump system operating in a heating mode, the refrigerant's direction of flow through heat exchanger 40, expansion device 42 and heat exchanger 44 is generally reversed so that indoor heat exchanger 44 functions as a condenser to heat air 30, and outdoor heat exchanger 40 functions as an evaporator to absorb heat from outdoor air 30*c*. If additional heat is needed or refrigerant circuit 38 is only operable in a cooling mode, heater 18 can be energized for heating air 30 while compressor 16 is de-energized. In the heating mode, damper 36 can be open or closed.

To control system 10 for regulating the air temperature of room 12, a temperature sensor 46 can provide controller 14 with a temperature feedback signal 48 that varies with the room's temperature. Such temperature sensors are well known to those of ordinary skill in the art. Sensor 46 can be installed in housing 32 to sense return air 30*a* as the air enters inlet 24, or sensor 46 can be a conventional wall-mounted thermostat that provides controller 14 with feedback signal 48 via wires or a wireless communication link.

In addition to feedback signal 48, controller 14 also has an input 50 for receiving a plurality of commands 52, such as a cooling setpoint temperature, a heating setpoint temperature, a heating command, a cooling command and a dehumidify command (or dehumidification offset temperature). Input 50 can be in the form of a keyboard, touch pad, selector switch, push buttons, and various combinations thereof. The cooling setpoint temperature can be a user-inputted desired target temperature for room 12 when the room generally needs cooling. The heating setpoint temperature can be a desired target temperature for room 12 when the room generally needs heating. In some embodiments, the cooling setpoint temperature and the heating setpoint temperature are the same, i.e., there is only one user-adjustable temperature setpoint for both heating and cooling. The heating, cooling and dehumidify commands can also be manually inputted and used for determining whether system 10 operates in a heating mode, cooling mode, or dehumidifying mode.

Figure 3:
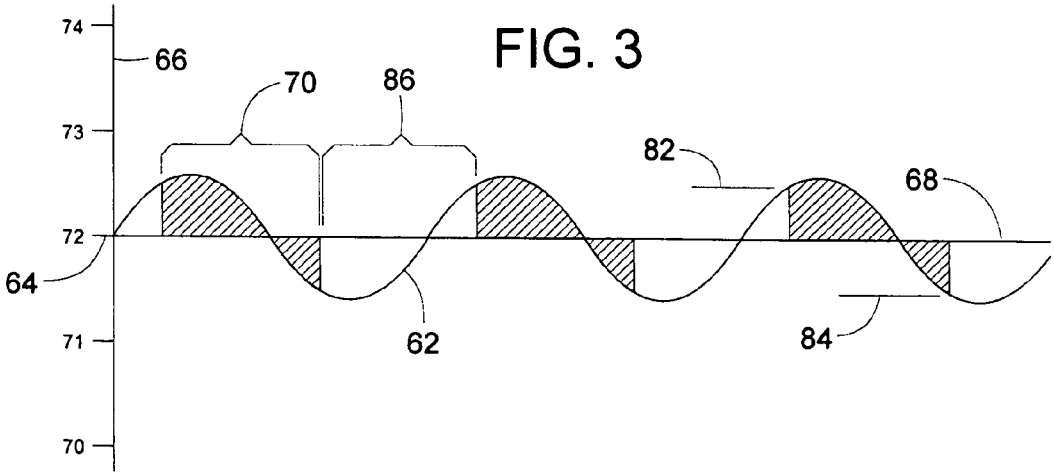
FIG. 3 is a graph illustrating the method in which the refrigerant system operates in a cooling mode.

In the cooling mode, controller 14 provides outputs 54, 56, 58 and 60 for controlling the operation of compressor 16, damper 36, and fans 58 and 60 such that the room temperature is kept within a certain range of the cooling setpoint temperature. The graph of FIG. 3, for example, represents controller 10 regulating room temperature 62 within about 0.5° F. of a cooling setpoint temperature 64 of 72° F. With a vertical axis 66 of the graph representing temperature and a horizontal axis 68 representing time, the graph shows room temperature 62 cyclically varying between about 72.5° F. and 71.5° F. with perhaps some overshoot. An on-period 70 represents compressor 16 and fans 28 and 34 being energized to cool room 12 as a result of room temperature 62 having risen to a predetermined upper temperature limit 82. In this particular example, upper temperature limit 82 is 72.5° F. Once the compressor and fans are energized, system 10 continues to cool room 12 until the room temperature, as sensed by temperature sensor 46, reaches a predetermined lower temperature limit 84 of, for example, 71.5° F., at which point controller 14 de-energizes compressor 16 and fan 34 (and possibly de-energizes fan 28 as well). Once the equipment is de-energized, the room temperature may begin rising during an off-period 86 until the room temperature once again reaches upper temperature limit 82 to repeat the cycle. Cooling a comfort zone using such an on/off control scheme, as well as variations thereof, is well known to those of ordinary skill in the art.

Figure 4:
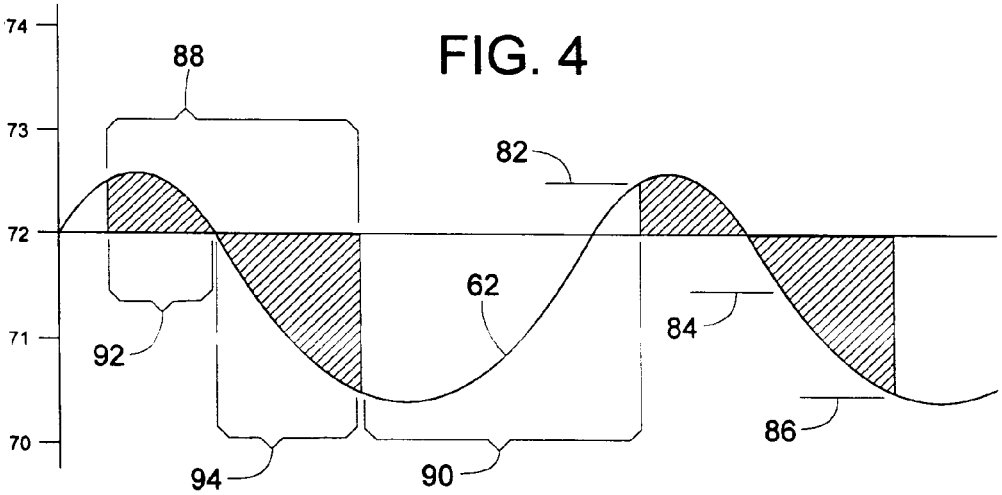
FIG. 4 is a graph illustrating the method in which the refrigerant system operates in a dehumidifying mode.

For the user-selected dehumidifying mode, the dehumidify command entered into input 50 effectively lowers the cooling setpoint temperature by a certain offset amount, and commands controller 14 to operate system 10 differently than during the cooling mode. Controller 14 in the dehumidifying mode regulates the room temperature 62 between upper temperature limit 82 (e.g., 72.5° F.) and a predetermined subcooling temperature limit 86 (e.g., 70.5° F.), as shown in the graph of FIG. 4. In this example, subcooling temperature limit 86 is about one degree less than the lower temperature limit 84 used for the cooling mode of FIG. 3. In addition, controller 14 controls the operation of compressor 16, fan 28, and damper 36 so as to improve the refrigerant system's ability to reduce the humidity of the air in room 12 beyond that which could be achieved by the aforementioned cooling mode alone.

As with the cooling cycle, the dehumidifying cycle also has an on-period 88 and an off-period 90 in which compressor 16 is respectively energized and de-energized. Unlike the cooling cycle, however, the dehumidifying cycle's on-period 88 has a first period 92 and a second period 94 in which system 10 operates differently. Upon going from first period 92 to second period 94, controller 14 decreases the speed of fan 28 and ensures that damper 36 is closed. Damper 36 may or may not be open during first period 92. A typical operating sequence for the dehumidifying mode could be as follows:

During first period 92, compressor 16 is energized and fan 28 is operating at full speed or at some other desired speed to cool room 12. At the same time, damper 36 is preferably open (partially or fully) to provide at least some ventilation. After the room temperature decreases to a setpoint temperature (e.g., 72° F. or an offset temperature of 71° F.), second period 94 begins, at which time controller 14 decreases the speed of fan 28 and closes damper 36. The setpoint temperature between periods 92 and 94 can be the previously set cooling setpoint temperature 64 or an offset thereof. Regardless, the slower fan speed during second period 94 lowers the surface temperature of heat exchanger 44, which makes the heat exchanger more effective at removing moisture from the air. Keeping damper 36 closed during second period 94 avoids introducing moist outside air 30*a* into room 12. Allowing the room temperature to decrease below lower temperature limit 84 to subcooling temperature limit 86 prolongs the dehumidifying process that occurs during second period 94.

After the room temperature reaches subcooling temperature limit 86, controller 14 de-energizes compressor 16 to begin off-period 90. During off-period 90, room temperature 62 may begin rising until the room temperature once again reaches upper temperature limit 82 to repeat the cycle.

Figure 5:
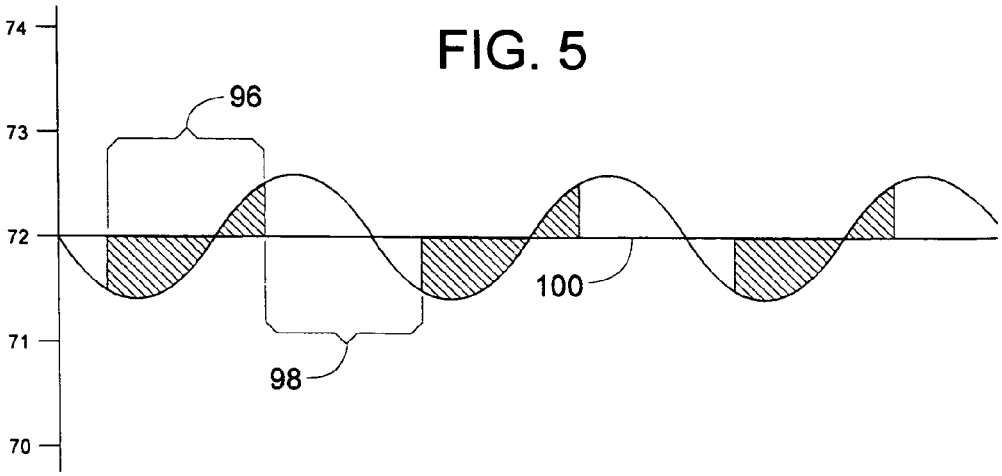
FIG. 5 is a graph illustrating the method in which the refrigerant system operates in a heating mode.

In the heating mode, as shown in FIG. 5, electric heater 18 is periodically energized during an on-period 96 and de-energized during an off-period 98 to help maintain the room temperature near a heating setpoint temperature 100, wherein heating setpoint 100 may or may not be the same as cooling setpoint temperature 64.

Although the invention is described with respect to a preferred embodiment, modifications thereto will be apparent to those of ordinary skill in the art. Fan 28, for instance, can be two-speed or infinitely variable. It should be noted that controller 14 could include any appropriate microprocessor or circuitry that can provide the control scheme just described. The scope of the invention, therefore, is to be determined by reference to the following claims.

The invention claimed is:

1. A method of operating a refrigerant system to control an air temperature associated with a comfort zone by providing the comfort zone with air that may include some outside air, wherein the refrigerant system includes a compressor; a fan selectively operable at a faster speed and a slower speed to move the air at different flow rates; and a fresh air damper selectively movable to an open position for introducing the outside air into the comfort zone and a substantially closed position for substantially inhibiting the outside air from entering the comfort zone, the method comprising:

establishing a setpoint temperature;

cyclically operating the refrigerant system above and below the setpoint temperature;

running the compressor, positioning the fresh air damper to its open position, and running the fan at the higher speed for a first period when the refrigerant system is operating above the setpoint temperature; and running the compressor, positioning the fresh air damper to its substantially closed position, and running the fan at the lower speed for a second period when the refrigerant system is operating below the setpoint temperature.

2. The method of claim 1, wherein the air temperature is decreasing during the first period.

3. The method of claim 2, wherein the air temperature is decreasing during the second period.

4. The method of claim 3, wherein the air temperature decreases more during the second period than during the first period, and wherein the second period is longer than the first period.

5. The method of claim 1, wherein the air temperature is decreasing during the second period.

6. The method of claim 1, wherein the air temperature decreases more during the second period than during the first period.

7. The method of claim 1, wherein the second period is longer than the first period.

8. The method of claim 1, further comprising ignoring a response from any humidity sensor.

9. A method of operating a refrigerant system to control an air temperature associated with a comfort zone, wherein the refrigerant system is selectively operable in a cooling mode and a dehumidifying mode to provide the comfort zone with air that may include some outside air, wherein the refrigerant system includes a compressor; a fan selectively operable at a faster speed and a slower speed to move the air at different flow rates; and a fresh air damper selectively movable to an open position for introducing the outside air into the comfort zone and a substantially closed position for substantially inhibiting the outside air from entering the comfort zone, the method comprising:

establishing a setpoint temperature, an upper temperature limit, a lower temperature limit, and a sub-cooling temperature limit, wherein the setpoint temperature is between the upper temperature limit and the lower temperature limit, and the sub-cooling temperature limit is less than the lower temperature limit;

in the cooling mode, controlling the compressor and the fan to regulate the air temperature between the upper temperature limit and the lower temperature limit;

in the dehumidifying mode, controlling the compressor, the fan, and the fresh air damper to regulate the air temperature between the upper temperature limit and the sub-cooling temperature limit and doing so regardless of any change in the humidity of the air;

in the dehumidifying mode, running the fan at the faster speed when the air temperature is above the setpoint temperature and is decreasing;

in the dehumidifying mode, running the fan at the slower speed when the air temperature is below the setpoint temperature and is decreasing; and in the dehumidifying mode, closing the fresh air damper as the air temperature is decreasing toward the sub-cooling temperature limit.

10. The method of claim 9, further comprising ignoring a response from any humidity sensor during the dehumidifying mode.

11. A refrigerant system charged with a refrigerant and being operable to provide a comfort zone with air that includes at least one of a recirculated air and an outside air, the refrigerant system comprising:

a compressor for compressing the refrigerant;

an evaporator through which the compressor forces the refrigerant to flow in order to cool the air;

an electric heater for heating the air;

a fresh air damper being selectively movable to an open position for introducing the outside air into the comfort zone, and a substantially closed position for substantially inhibiting the outside air from entering the comfort zone;

a fan for forcing the air across the evaporator and across the electric heater;

a temperature sensor providing a temperature feedback signal that varies in response to an air temperature of the comfort zone;

an input for providing a plurality of commands including a cooling setpoint temperature, a heating setpoint temperature, a heating command, a cooling command and a dehumidify command; and a controller operatively coupled to receive the temperature feedback signal from the temperature sensor, operatively coupled to the input to receive the plurality of commands, and operatively coupled to control the compressor, the fan, the electric heater and the fresh air damper such that:

a) in response to the heating command, the controller controls the electric heater and the fan to regulate the air temperature of the comfort zone at about the heating setpoint temperature;

b) in response to the cooling demand, the controller controls the compressor, the fan and the fresh air damper to regulate the air temperature of the comfort zone at about the cooling setpoint temperature; and c) in response to the dehumidify command, the controller controls the compressor, the fan, and the fresh air damper to help maintain the air temperature between an upper temperature limit and a lower temperature limit, wherein the following is true:

(i) the cooling setpoint temperature is closer to the upper temperature limit than to the lower temperature limit;

(ii) the fan runs at a faster speed and the fresh air damper can be open when the air temperature is between the cooling setpoint temperature and the upper limit while the air temperature is decreasing; and (iii) the fan runs at a slower speed, the electric heater is deactivated, and the fresh air damper is at the substantially closed position when the air temperature is between the cooling setpoint temperature and the lower temperature limit while the air temperature is decreasing.

12. The refrigerant system of claim 11, wherein the cooling setpoint temperature is the same as the heating setpoint temperature.

13. The refrigerant system of claim 11, wherein the controller operating in response to the dehumidify command does so independently of any humidity sensor.

14. The refrigerant system of claim 11, wherein the controller operating in response to the dehumidify command does so independently of any humidity sensor.

15. The refrigerant system of claim 11, wherein the controller operating in response to the dehumidify command can continue to do so regardless of any change in the humidity of the air.

* * * * *